US007779497B2

(12) United States Patent
Chiu et al.

(10) Patent No.: US 7,779,497 B2
(45) Date of Patent: Aug. 24, 2010

(54) MULTI-FUNCTION PACKAGE OPENER

(75) Inventors: Ming-Hsiang Chiu, Taichung (TW); Scott A. Pyle, Vernon Hills, IL (US); Michael M Sherman, Mooresville, NC (US)

(73) Assignee: Zibra, LLC, Mooresville, NC (US)

( * ) Notice: Subject to any disclaimer, the term of this patent is extended or adjusted under 35 U.S.C. 154(b) by 181 days.

(21) Appl. No.: 11/989,808

(22) PCT Filed: Aug. 2, 2006 (Under 37 CFR 1.47)

(86) PCT No.: PCT/US2006/030216

§ 371 (c)(1), (2), (4) Date: Jan. 31, 2008

(87) PCT Pub. No.: WO2007/016648

PCT Pub. Date: Feb. 8, 2007

(65) Prior Publication Data

US 2009/0282619 A1 Nov. 19, 2009

Related U.S. Application Data

(60) Provisional application No. 60/704,627, filed on Aug. 2, 2005.

(51) Int. Cl.
*B26B 13/00* (2006.01)

(52) U.S. Cl. ..... 7/158; 7/165; 30/254

(58) Field of Classification Search ..... 7/158, 7/165, 168, 118, 128–136; 81/416, 418, 81/420, 424.5; 30/2, 257, 341, 254
See application file for complete search history.

(56) References Cited

U.S. PATENT DOCUMENTS

| | | | | | |
|---|---|---|---|---|---|
| 348,749 | A * | 9/1886 | Kimbler | ..... | 7/131 |
| 541,294 | A * | 6/1895 | Smith | ..... | 30/257 |
| 673,043 | A * | 4/1901 | Burner | ..... | 30/257 |
| 929,749 | A * | 8/1909 | Bishop | ..... | 30/257 |
| 1,182,561 | A * | 5/1916 | Hanscom | ..... | 30/146 |
| 1,216,886 | A * | 2/1917 | Thomson | ..... | 81/420 |
| 1,686,640 | A * | 10/1928 | Pierce, Jr. | ..... | 81/418 |

(Continued)

FOREIGN PATENT DOCUMENTS

WO WO8804223 6/1988

*Primary Examiner*—Hadi Shakeri
(74) *Attorney, Agent, or Firm*—Wegman, Hessler & Vanderburg

(57) ABSTRACT

A package opener (10) includes first and second opposed elongate members joined together for scissor action about a pivot joint (16). The first member (12) includes a first handle grip (18) at a rear end and a first cutting element (20) having a first blade (26) at a front end. The second member (13) includes a second handle grip (19) at a rear end and a second cutting element (21) having a second blade (27) at a front end thereof. The cutting elements include a leg portion (40,41) positioned between an arm segment (30,31) on which the pivot joint is located and the blade. Each cutting element also has a gap (G) in the blade portion. The leg portions and the gap enable the cutting elements, when opened, to fit over a package lip of a blister-type package so that the package opener can cut around the interior perimeter of the package lip to open the package. The multi-function package opener may also have a miniature utility knife blade (50) and at least one screwdriver (60).

10 Claims, 6 Drawing Sheets

U.S. PATENT DOCUMENTS 2,136,414 A * 11/1938 Clements ..... 606/174
2,250,638 A 7/1941 Kubinec
3,055,108 A * 9/1962 March ..... 30/257
3,293,673 A * 12/1966 Olney ..... 7/132
4,462,157 A 7/1984 Aiken
4,729,150 A * 3/1988 Breaux et al. ..... 452/105
4,967,475 A 11/1990 O'Keeffe et al.
5,339,712 A * 8/1994 Keyvani ..... 81/416
D427,037 S * 6/2000 Schmithorst ..... D8/57
7,096,586 B2 * 8/2006 Carpenter et al. ..... 30/146
2001/0004858 A1 * 6/2001 Kachergius ..... 81/424.5
2004/0078035 A1 * 4/2004 Kanehira et al. ..... 606/28
2004/0255731 A1 12/2004 Berg et al.
2009/0126539 A1 * 5/2009 Foley ..... 81/418

* cited by examiner

MULTI-FUNCTION PACKAGE OPENER

REFERENCE TO RELATED APPLICATION

The present application claims priority under 35 U.S.C. §119(e) to U.S. Provisional Patent Application No. 60/704,627, filed Aug. 2, 2005 and entitled MULTI-FUNCTION PACKAGE OPENER.

BACKGROUND OF THE INVENTION

1. Field of Invention

This invention relates to multi-purpose tools, and more specifically to a multi-function package opener.

2. Description of Related Art

Consumer goods are increasingly being packaged in durable plastic containers commonly referred to as plastic clam shells or heat-sealed blister packs. Typically, consumers have had to rely on conventional scissors or knives to open these packages. However, these tools are not specifically designed for such uses, and often fail to provide a suitable and safe way to open the wide variety of common consumer goods packaging. Additionally, once the package has been successfully opened, the consumer often must search for another tool to remove twist-on fasteners, slice any tape or cardboard securing the product, as well as search for the proper screwdriver to open battery compartments and the like of many consumer electronic products.

There is a need for an improved multi-function package opener tool that provides greater utility and convenience to the user, as well as a greater level of safety.

SUMMARY OF THE INVENTION

The invention provides a new and improved package opening tool that is simple in design, effective in use, and overcomes the aforementioned disadvantages. One aspect of the invention is directed to a multi-function package opening tool. The package opener includes first and second opposed elongate members joined together for scissor action about a pivot joint. The first member has a first handle grip at a rear end and a first cutting element having a first blade with a cutting edge at a front end thereof and a first arm segment intermediate the handle grip and blade. The second member has a second handle grip at a rear end and a second cutting element having a second blade with a cutting edge at a front end thereof and a second arm segment intermediate the handle grip and blade. The first and second arm segments are joined by a connector to form the pivot joint. The first and second blades are offset from a plane passing through the first and second handle grips. Additionally, the first and second cutting elements are shaped so as to form a gap G between the cutting edges and the arm segments. In one embodiment, each of the cutting elements includes a leg portion positioned between the arm segment and the blade, wherein the leg portion extends from the arm segment at an angle $\gamma$ of between 75 and 105 degrees to form the offset. The offset blades and the gap enable the cutting elements, when in the opened position, to fit over a package lip of a blister-type package so that the package opener can cut around the interior perimeter of the package lip to open the package.

Another aspect of the invention is a multi-function package opener that also has a miniature utility knife blade and at least one screwdriver.

BRIEF DESCRIPTION OF THE DRAWINGS

The above mentioned and other features of this invention will become more apparent and the invention itself will be better understood by reference to the following description of embodiments of the invention taken in conjunction with the accompanying drawings, wherein.

Corresponding reference characters indicate corresponding parts throughout the views of the drawings.

DETAILED DESCRIPTION OF EXEMPLARY EMBODIMENTS

The invention will now be described in the following detailed description with reference to the drawings, wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description.

Figure 1:
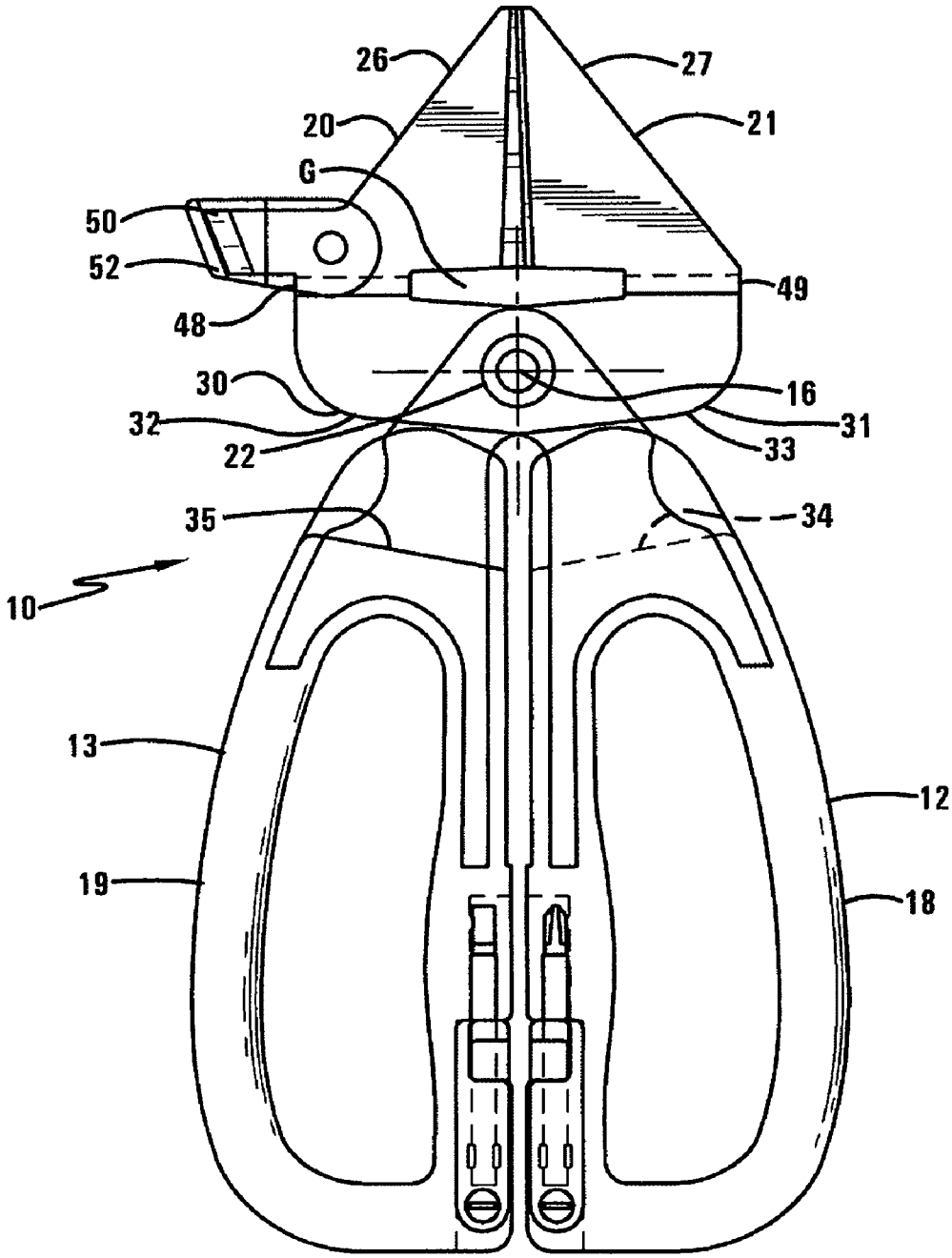
FIG. 1 is a illustrates a multi-function package opener according to one embodiment of the invention.

Referring now to the drawings, FIG. 1 shows a multi-function package opener 10 including first and second opposed elongate members 12, 13 joined together for scissor action about a pivot joint 16. Member 12 comprises a first handle grip 18 at a rear end and a first cutting element 20 at a front end. Similarly, member 13 comprises a second handle grip 19 at a rear end and a second cutting element 21 at a front end. The first and second handle grips 18, 19 are desirably soft grip handles affixed on the elongate members 12, 13 using any known method. The first and second members 12, 13 are joined at the pivot joint 16 by a connector such as a rivet or pin 22.

Figure 2:
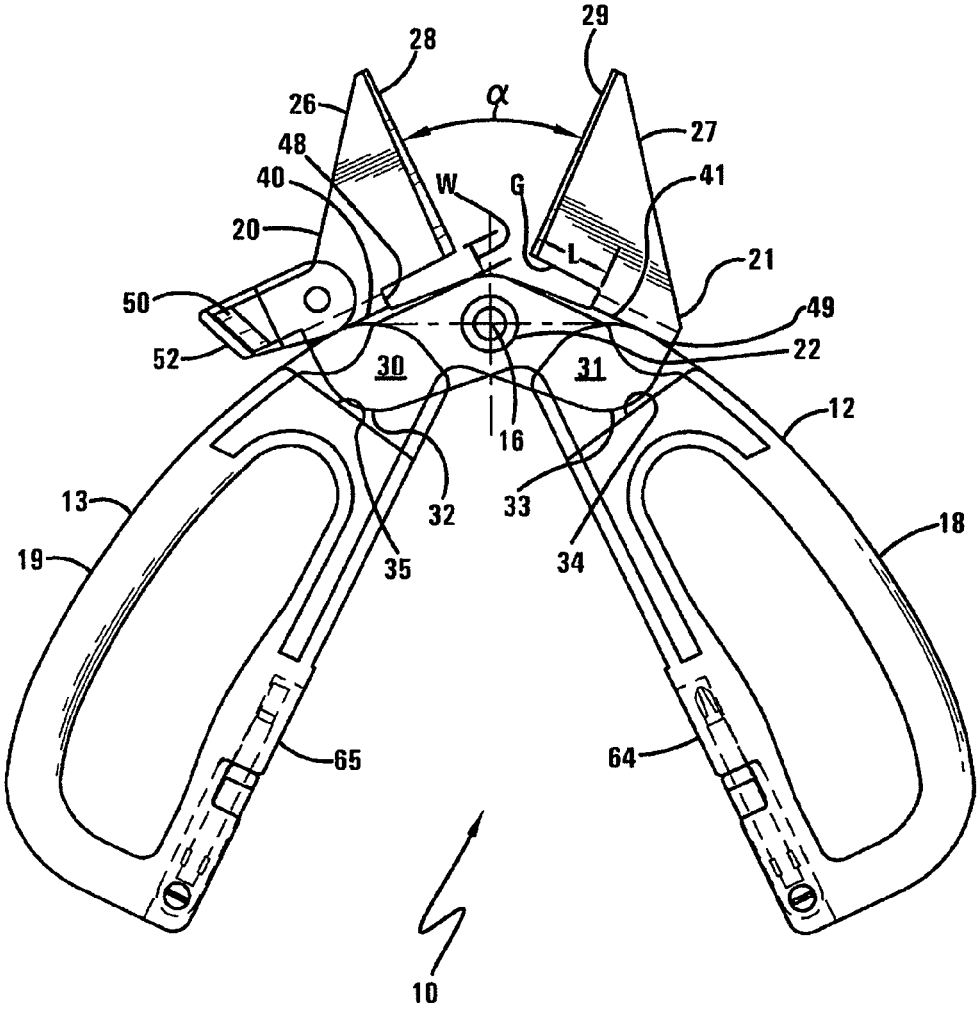
FIG. 2 is another view of the package opener of FIG. 1.

The cutting elements 20, 21 have first and second blade portions 26, 27 that meet along a center axis when the handle grips 18, 19 are closed. As best seen in FIG. 2, blade portion 26 has a cutting edge 28 which matingly engages a cutting edge 29 of blade portion 27. The first and second members 12, 13 are positioned opposite each other such that the cutting elements 20, 21 pivot open to an angle $\alpha$ desirably between about 40 degrees to about 60 degrees, and more desirably about 50 degrees.

Each cutting element 20, 21 has an arm segment 30, 31 intermediate the handle portion 18, 19 and the blade portions 26, 27 on which the pivot joint 16 is located. The arm segments 30, 31 are generally in planes perpendicular with the axis of the pivot joint 16. In one embodiment, rear portions of the arm segments 30, 31 form respective elbows 32, 33. Upon pivoting to the maximum desired open position, each elbow 32, 33 contacts a ridge stop 34, 35 in the handle grip 18, 19 of the opposing member 12, 13 to limit the maximum angle that the cutting blades 26, 27 can be separated.

Figure 3:
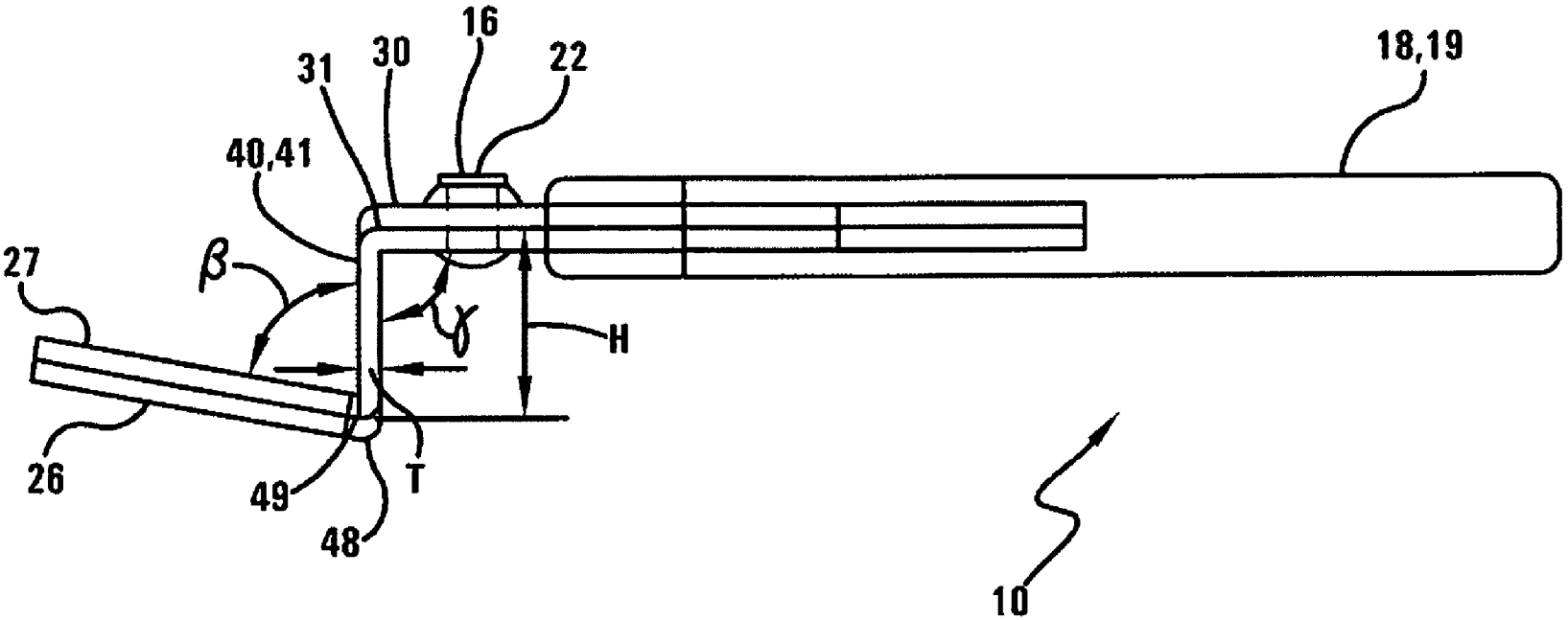
FIG. 3 is a side view of the package opener of FIG. 1.
Figure 4:
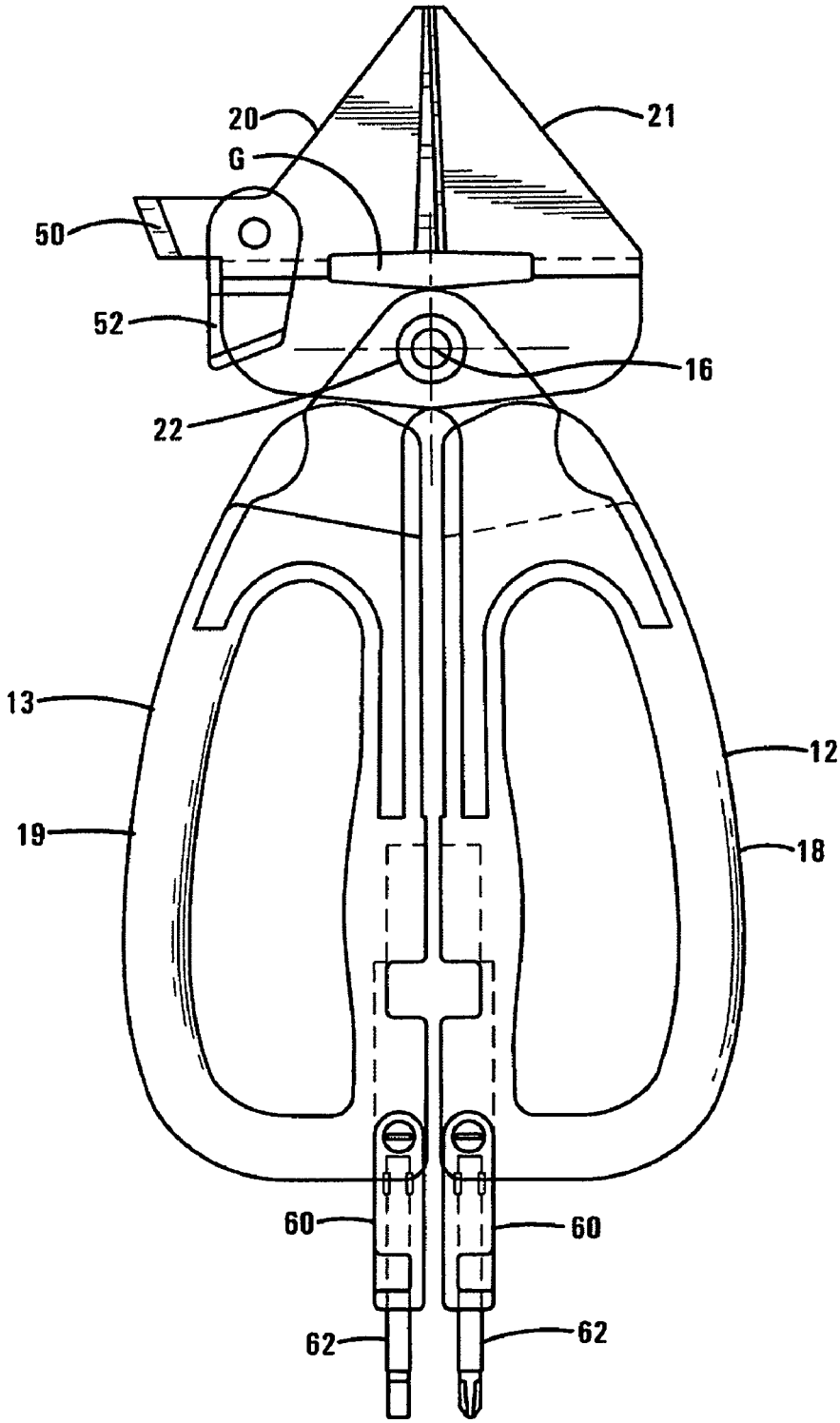
FIG. 4 is a view of the package opener of FIG. 1 with screwdrivers and mini cutting blade extended.

As best seen in the side view of FIG. 3, the cutting blades 26, 27 are offset from the plane that runs through both handle grips 18, 19. Each cutting element 20, 21 has a generally vertical leg portion 40, 41 extending from the respective arm segment 30, 31 to the cutting blade 26, 27. The leg portions 40, 41 form an offset having a height H between the arm segments 30, 31 and where the cutting edges 28, 29 meet at the base of the cutting blades 26, 27. Desirably, the height H of the offset is between about 10 mm and about 40 mm, and more preferably between about 20 mm and about 30 mm. In one embodiment, each of the leg portions 40, 41 is generally orthogonal with the arm segment 30, 31 to create the offset. However, the leg portions 40, 41 can extend from the arm segments 30, 31 at another suitable angle γ, but desirably between about 75 degrees and about 105 degrees, to create the desired offset height H separation between the arm segments 30, 31 and the cutting blades 26, 27.

In the illustrated embodiment, the blade portions 26, 27 of the cutting element 20, 21 extend at an incline angle β from the leg portions 40, 41. Desirably, the incline angle β is between about 55 degrees and about 90 degrees, more desirably between about 60 and 85 degrees, and even more preferably between about 70 and 80 degrees. This incline angle β facilitates cutting such that when the package opener 10 is pushed forward against an item to be cut, the item can be easily cut along a straight line in a quick and safe manner. Desirably, at least the cutting elements 20, 21 are formed of stainless steel or like material, and the non-cutting portions of the cutting blades 26, 27 and the leg and arm segments 30, 31, 40, 41 of the opener 10 have a thickness T of between about 2.0 mm and about 2.4 mm, and more desirably about 2.2 mm. However, other thicknesses may be used without departing from the scope of the invention.

As best seen in the views of FIGS. 1, 2, 5 and 6, the cutting elements 20, 21 are shaped to form a slot or gap G when looking down on the opener 10 as in these Figures. In one embodiment, the cutting edges 28, 29 of the cutting blades 26, 27 extend only a portion of the total length of the cutting blades such that a rear portion of each cutting blade forms a neck 48, 49 that transitions into its respective leg portion 40, 41. The cutting blade 26, 27 is narrower at its neck 48, 49 than at the portion leading to the cutting edge 28, 29 so that the rear portion of the cutting edge 28, 29 is spaced both horizontally and vertically from the arm portions 30, 31. The vertical spacing was explained above and corresponds to height H of the offset. When looking from above as in FIGS. 1 and 2, the horizontal spacing that forms the gap G between the rear portion of the cutting edge 28, 29 and the most forward part of arm portion 30, 31 has a width W. Desirably, the width W of gap G is between about 5 mm and about 25 mm and more desirably between about 10 mm and about 15 mm. The gap G in each cutting element 20, 21 has a length L defined as the distance from the cutting edge 28, 29 to the neck 48, 49 in the cutting blade 26, 27 as seen in FIG. 2. Desirably, the length L of gap G is between about 5 mm and about 25 mm and more desirably between about 10 mm and about 15 mm. As can be seen in the embodiment illustrated in FIG. 6, the cutting blades 26, 27 may overlap when the cutting elements 20, 21 are in the closed position such that the total combined length of the gap G formed by both of the cutting elements 20, 21 may be less than two times the length L of the gap G formed in the individual cutting elements. In one embodiment, the neck 48, 49 and the adjoining leg portion 40, 41 have a width of about one half the width of the cutting blade 26, 27 at the rear of the cutting edge 28, 29 such that the gap G extends from the cutting edges 28, 29 to about the midpoint of the blade 26, 27.

The novel shape of the offset cutting elements 20, 21 as a result of the offset-forming leg portions 40, 41 and the gap G enable the cutting blades 26, 27, when opened, to fit over a package "lip" of a blister-type package so that the package opener 10 can cut around the interior perimeter of the package lip. For example, the height H of the offset and the width W of gap G provide adequate room to maneuver the cutting elements 20, 21 over a traditional 10 mm high lip on a typical blister package. This feature allows the user to release the product from sealed blister type package by cutting through the seal at the inner perimeter of the sealed package from both top and bottom with the cutting blades 26, 27 in a safe and convenient manner.

Figure 5:
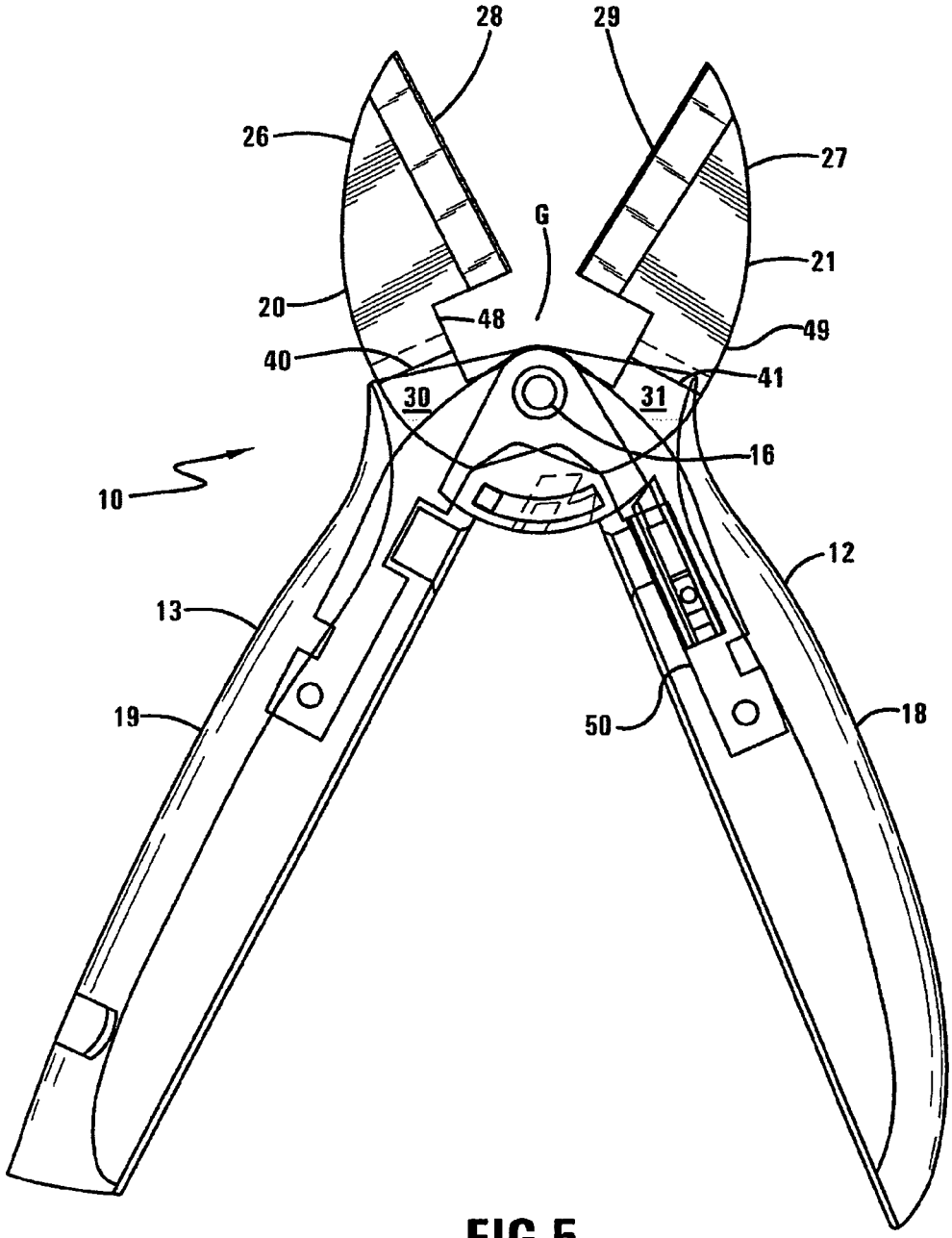
FIG. 5 is a view of an alternate embodiment of the multi-function package opener.
Figure 6:
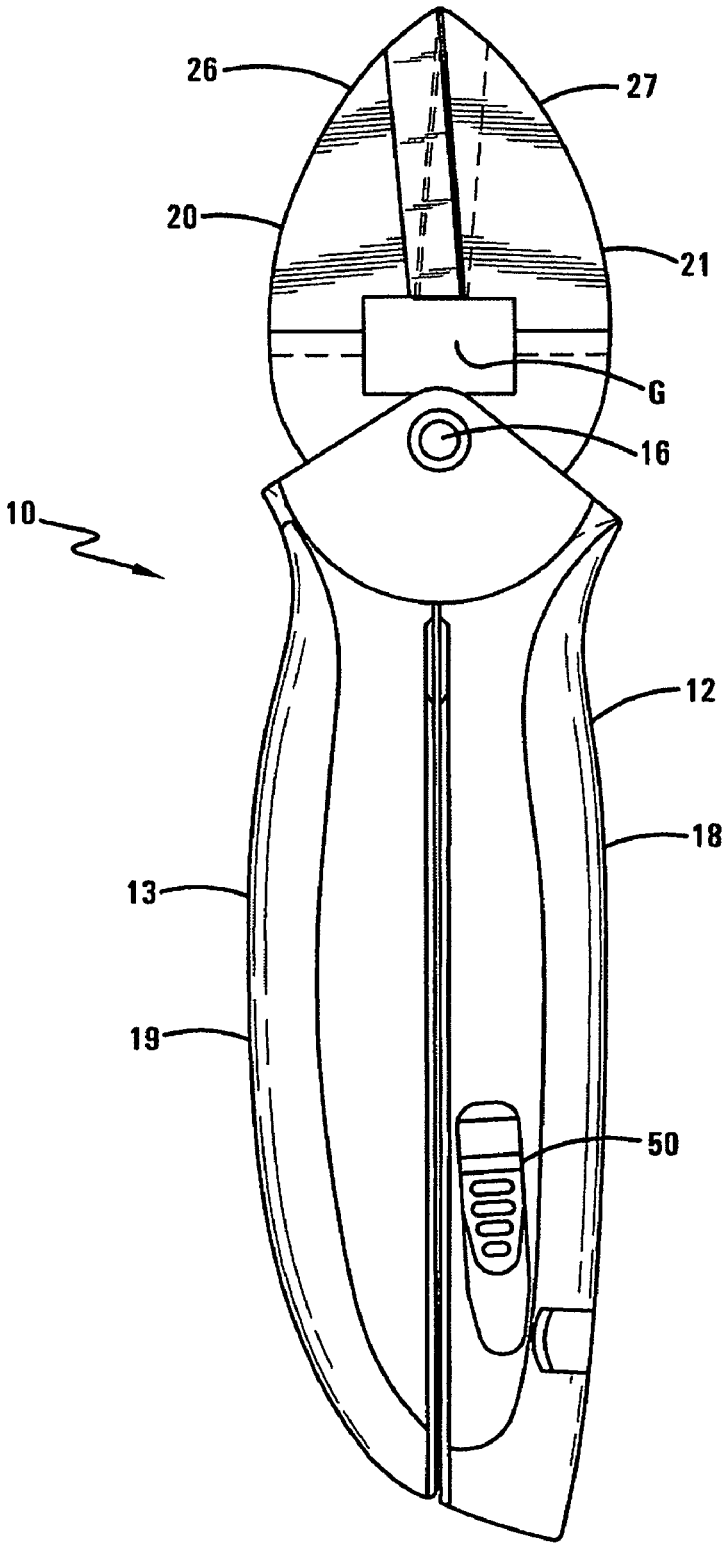
FIG. 6 is a yet another view of an embodiment of the multi-function package opener.

One of the members 12, 13 desirably contains a miniature utility knife blade 50. In one illustrated embodiment, the utility knife blade 50 swivels in a 90 degree rotation from its position on the left blade 26. A safety cover 52 swivels in a similar rotation to cover the exposed utility knife blade 50 and prevents it from creating an exposed sharp edge when not in use. Alternately, as illustrated in FIGS. 5 and 6, the utility knife 50 may be toward the rear of the tool 10 and may swivel or extend using a thumb knob from the handle.

In one embodiment, the left and right members 12, 13 have a removable screwdriver 60 that can be re-inserted in an inverse position to convert the 'nested' screwdriver bit 62 into a full size handle grip screwdriver. In the illustrated embodiment, the screwdriver 60 is nested in an interior leg 64, 65 of the handle grips 18, 19. Desirably, each of the interior legs 64, 65 hold a screwdriver 60 of differing type. In one embodiment, the multi-function package opener 10 contains one #1 Phillips bit 62 and a 3/16" flat bit 62. These sizes are the most commonly used in electronic gadget or toy products by manufacturers. However, other sizes of bits may be used.

Accordingly, the package opener 10 provides an improved opener that can be used to open a wide variety of consumer goods packages such as plastic clam shells, heat sealed blister packs, or even common cardboard boxes. The package opener 10 can also be used to remove 'twisty ties' or cable ties that are used by manufactures to secure products to the packaging material, and additionally can be used to open the battery compartment of common electronics and toy products. The scissor-like cutting blades 26, 27 also serve as a quick and safe method to un-fasten products such as toys that are secured to the package back or inner support material by twisted cable or zip ties. This utility knife 50 feature is preferred for slicing through CD and DVD plastic wraps as well as to open taped shipping cartons, poly bags, etc.

While this invention has been described in conjunction with the specific embodiments described above, it is evident that many alternatives, combinations, modifications and variations are apparent to those skilled in the art. Accordingly, the preferred embodiments of this invention, as set forth above are intended to be illustrative only, and not in a limiting sense. Various changes can be made without departing from the spirit and scope of this invention.

What is claimed is:

1. A multi-function package opener comprising first and second opposed elongate members joined together for scissor action about a pivot joint, the first member comprising a first handle grip at a rear end and a first cutting element having a first blade with a cutting edge at a front end thereof and a first arm segment intermediate the handle grip and blade, and the second member comprising a second handle grip at a rear end and a second cutting element having a second blade with a cutting edge at a front end thereof and a second arm segment intermediate the handle grip and blade, the first and second arm segments being joined by a connector to form the pivot joint, the package opener characterized in that each of the cutting elements further includes a leg portion positioned between its arm segment and blade, wherein each cutting element is shaped such that the leg portion is orthogonal with the arm segment and the blade extends at an incline angle β between 55 degrees and 85 degrees from the leg portion such that the first and second blades are offset between about 10 mm and about 30 mm from a plane passing through the first and second handle grips and a gap G having horizontal and vertical components is formed between the cutting edges and the arm segments.

2. The multi-function package opener according to claim 1 wherein the cutting elements pivot open to an angle α of between 40 degrees and 60 degrees between the cutting edges.

3. The multi-function package opener according to claim 1 wherein each of the blades forms a neck that transitions into its respective leg portion such that the blade is narrower at its neck than at a location adjacent the cutting edge to form the gap G.

4. The multi-function package opener according to claim 3 wherein a width W of gap G is between about 5 mm and about 25 mm.

5. The multi-function package opener according to claim 4 wherein the gap G and has a length L defined as the distance from the cutting edge to the neck in the cutting blade, wherein the length L is between 5 mm and 25 mm.

6. The multi-function package opener according to claim 1 further comprising a utility knife blade.

7. The multi-function package opener according to claim 6 wherein the utility knife blade swivels in a 90 degree rotation from its position on one of the blades.

8. The multi-function package opener according to claim 7 further comprising a safety cover that swivels to cover the utility knife blade and prevent it from creating an exposed sharp edge when not in use.

9. The multi-function package opener according to claim 1 further at least one screwdriver nested in an interior leg of one of the elongate members.

10. The multi-function package opener according to claim 1 wherein non-cutting edge portions of the cutting elements have a thickness T of between about 2.0 and about 2.4 mm.

* * * * *